US006533878B1

(12) United States Patent
Fonblanc

(10) Patent No.: US 6,533,878 B1
(45) Date of Patent: Mar. 18, 2003

(54) PYROTECHNIC COMPOSITIONS GENERATING NON-TOXIC GASES BASED ON AMMONIUM PERCHLORATE

(75) Inventor: Gilles Fonblanc, Bordeaux (FR)

(73) Assignee: Societe Nationale des Poudres et Explosifs, Paris Cedex (FR)

( * ) Notice: Subject to any disclaimer, the term of this patent is extended or adjusted under 35 U.S.C. 154(b) by 0 days.

(21) Appl. No.: 09/554,042

(22) PCT Filed: Dec. 10, 1998

(86) PCT No.: PCT/FR98/02684

§ 371 (c)(1),
(2), (4) Date: May 9, 2000

(87) PCT Pub. No.: WO99/31029

PCT Pub. Date: Jun. 24, 1999

(30) Foreign Application Priority Data

Dec. 12, 1997 (FR) ..... 97 15745

(51) Int. Cl.[7] ..... C06B 29/22; C06B 31/00
(52) U.S. Cl. ..... 149/76; 149/45
(58) Field of Search ..... 149/45, 76

(56) References Cited

U.S. PATENT DOCUMENTS

| | | | | | |
|---|---|---|---|---|---|
| 3,723,205 | A | | 3/1973 | Scheffee | 149/19 |
| 3,814,694 | A | | 6/1974 | Klager et al. | 252/186 |
| 3,964,256 | A | | 6/1976 | Plantiff et al. | 60/219 |
| 3,986,908 | A | | 10/1976 | Grebert et al. | 149/19.7 |
| 4,165,247 | A | * | 8/1979 | Brew et al. | 149/19.4 |
| 4,909,549 | A | | 3/1990 | Poole et al. | 280/738 |
| 5,139,587 | A | * | 8/1992 | Strecker et al. | 149/19.9 |
| 5,486,248 | A | * | 1/1996 | Taylor et al. | 149/109.6 |
| 5,538,568 | A | * | 7/1996 | Taylor et al. | 149/70 |
| 5,608,183 | A | * | 3/1997 | Barnes et al. | 149/45 |
| 5,610,444 | A | | 3/1997 | Austruy et al. | 264/3.3 |
| 5,780,768 | A | * | 7/1998 | Knowlton et al. | 149/36 |
| 5,783,769 | A | * | 7/1998 | Goleniewski et al. | 149/19.6 |
| 5,841,065 | A | * | 11/1998 | Mendenhall | 149/37 |
| 5,854,442 | A | * | 12/1998 | Scheffee et al. | 149/18 |
| 5,882,036 | A | * | 3/1999 | Moore et al. | 280/736 |
| 6,039,820 | A | * | 3/2000 | Hinshaw et al. | 149/45 |

FOREIGN PATENT DOCUMENTS

| | | | |
|---|---|---|---|
| EP | 0519485 | 6/1992 | C06D/5/06 |
| EP | 0716060 | 7/1997 | |
| WO | 9808782 | 3/1998 | C06B/25/34 |
| WO | 9847836 | 10/1998 | |

* cited by examiner

*Primary Examiner*—Michael J. Cardone
*Assistant Examiner*—Aileen B. Felton
(74) *Attorney, Agent, or Firm*—Bucknam and Archer

(57) ABSTRACT

The invention concerns pyrotechnic mixtures generating non-toxic gases characterised in that they essentially consist of a cross-linkable reducing binder based on epoxy resin or silicone resin, an oxidising filler based on ammonium perchlorate and a chlorine scavenger such as sodium nitrate and energetic additives consisting of a cupric compound such as cupric oxide or basic copper nitrate and of a nitrogenated organic compound such as, for example, nitroguanidin or guanidine nitrate. The filler can also contain potassium perchlorate. Said compositions burn at moderate temperatures generating gases rich in nitrogen and poor in nitrogen oxides and carbon monoxide. They are most suitable as pyrotechnic load for gas generators designed to inflate protective air bags for motor vehicle passengers.

12 Claims, No Drawings

PYROTECHNIC COMPOSITIONS GENERATING NON-TOXIC GASES BASED ON AMMONIUM PERCHLORATE

The present invention relates to the technical field of the pyrotechnic generation of gases that can be used especially in systems for protecting the occupants of a motor vehicle by means of bags which are inflated by the combustion gases of a pyrotechnic charge. More specifically, the invention relates to pyrotechnic compositions generating, at temperatures acceptable for motor-vehicle safety, clean gases, called "cold" gases, which are rich in nitrogen and are non-toxic.

For various pyrotechnic requirements and especially for ensuring that airbags are inflated correctly, the pyrotechnic gas generators must deliver, in extremely short times, of the order of thirty milliseconds, gases which are clean, that is to say contain no solid particles liable to form hot spots that can damage the wall of the bag, and are non-toxic, that is to say have low contents of nitrogen oxides, of carbon oxides and of chlorinated products.

Various families of pyrotechnic compositions have been developed for this purpose.

A first family relates to compositions based on an alkaline or alkaline-earth azide in the presence of a mineral oxidizing agent such as potassium nitrate or a metal oxide. These compositions, which may where appropriate include a binder, have major drawbacks. Firstly, when they burn they produce a great deal of dust which has to be filtered by relatively large filtration systems, thereby increasing both the weight and the cost of the generator. Secondly, azides are very toxic products which in addition have the possibility of forming lead azides or azides of other heavy metals, which are primary explosives. These compositions are therefore difficult to store satisfactorily for several years in a motor vehicle.

A second family relates to compositions based on nitrocellulose and on nitroglycerin. These compositions, also known by the name of "double-base powders", are very advantageous since they burn very quickly and produce no dust. However, they have the drawback of not being completely stable over time, which phenomenon, over the years, impairs the effectiveness of these compositions in a motor vehicle.

A third family relates to compositions called "composites", basically consisting of an organic binder and of an oxidizing mineral filler, especially such as a mineral perchlorate. These compositions are very advantageous since they have a good burn rate and excellent ageing stability.

Compositions have thus been proposed, in patent FR-A-2,137,619 or in its corresponding patent U.S. Pat. No. 3,723,205, in which the binder is a polyvinyl chloride and the oxidizing filler is an ammonium perchlorate in the presence of sodium nitrate as an internal chlorine scavenger. Nevertheless, the use of a chlorinated binder in the presence of energy-generating fillers is a tricky operation, especially from the standpoint of safety and from the non-toxicity of the gases generated.

Composite compositions have also been proposed which consist of a silicone binder that can be crosslinked at room temperature, also known by the name "RTV" (Room Temperature Vulcanizable) binder, and of potassium perchlorate, the potassium atom acting as an internal chlorine scavenger. Such compositions are, for example, described in patents FR-A-2,190,776 and FR-B-2,213,254 or their corresponding United States patents U.S. Pat. No. 3,986,908 and U.S. Pat. No. 3,964,256. However, these compositions have the drawback of generating very oxygen-rich gases which are not desirable for manufacturers in the motor-vehicle industry.

Composite compositions have therefore been proposed which consist of a silicone binder and of a mixture of ammonium perchlorate and sodium nitrate. Such compositions, which are described for example in French patent FR-A-2,728,562 or in its corresponding United States patent U.S. Pat. No. 5,610,444, do indeed generate clean, nitrogen-rich and non-toxic gases but they have the drawback of burning at very high temperatures.

Compositions have also been proposed which are based on ammonium perchlorate and sodium nitrate that are mixed with nitrogen compounds such as azides or metal nitrides. However, these compositions which are described for example in United States patent U.S. Pat. No. 3,814,694, have the drawbacks mentioned above with regard to compositions containing azides.

Finally, compositions have also been proposed which consist of a mixture of ammonium perchlorate and sodium nitrate, this mixture being combined with a nitrogen compound of triazole or of tetrazole. Such compositions, which are described for example in United States patent U.S. Pat. No. 4,909,549, do indeed generate clean, nitrogen-rich gases but these gases are relatively toxic and have to be diluted with air in order to be able to be used for motor-vehicle safety.

Those skilled in the art are thus still seeking pyrotechnic compositions which ignite easily, exhibit sustained combustion and generate, at temperatures acceptable for motor-vehicle safety, clean, nitrogen-rich, non-toxic clean gases. The object of the present invention is specifically to propose such compositions.

The invention therefore relates to a pyrotechnic gas-generating composition comprising especially a crosslinked reducing binder, additives and a main oxidizing filler comprising at least a mixture of ammonium perchlorate and of a chlorine scavenger chosen from the group consisting of sodium nitrate, lithium carbonate and potassium carbonate, the ammonium perchlorate/chlorine scavenger weight ratio being less than 5.0, characterized in that the weight content of the said binder represents at most 10% of the total weight of the composition, in that the weight content of the said main oxidizing filler is between 50% and 75% of the total weight of the composition and in that the said additives contain at least one copper compound chosen from the group consisting of cupric oxide CuO and of basic copper nitrate $Cu(NO_3)_2.3Cu(OH)_2$ and contain at least one organic nitrogen compound chosen from the group consisting of nitroguanidine, guanidine nitrate, oxamide, dicyandiamide of formula $C_2H_4N_4$, and metal cyanamides.

According to a first preferred embodiment of the invention, the said binder is chosen from the group consisting of crosslinkable binders based on a silicone resin, of crosslinkable resins based on an epoxy resin and of polyacrylic rubbers having reactive terminal groups such as, especially, epoxy or hydroxyl terminal groups. The weight content of the said binder will advantageously be between 6% and 10% of the total weight of the composition and the weight content of the said main oxidizing filler will then advantageously be between 70% and 75% of the total weight of the composition. Also advantageously, the ammonium perchlorate/chlorine scavenger weight ratio will be less than 4.0 and preferably less than 1.5.

A preferred chlorine scavenger is sodium nitrate and, in this case, according to a second preferred embodiment of the invention, the said main oxidizing filler will consist of coprecipitated ammonium perchlorate and sodium nitrate particles. Such particles are obtained, for example, by atomizing a solution of ammonium perchlorate and sodium nitrate and by evaporating the water contained in the droplets thus obtained. This atomization and this evaporation may be carried out using the apparatuses normally used to obtain coprecipitated salt granules. When the main oxidizing filler contains, alongside the sodium nitrate, other chlorine scavengers, it is also possible to make the latter participate in the coprecipitation.

The coprecipitated ammonium perchlorate and sodium nitrate particles generally have a particle size of between 10 $\mu$m and 50 $\mu$m.

According to a fourth preferred embodiment of the invention, the ammonium perchlorate/chlorine scavenger weight ratio is approximately 0.95.

According to a fifth preferred embodiment of the invention, the metal cyanamides will be chosen from sodium, zinc and copper cyanamides. Zinc cyanamide, of formula $ZnCN_2$, is particularly preferred.

According to a sixth preferred embodiment of the invention, the said main oxidizing filler also contains potassium perchlorate. In this case, the weight content of the said potassium perchlorate filler will advantageously be about approximately 1.7 times its ammonium perchlorate weight content.

By virtue of their low binder content and by virtue of the presence of reactive additives alongside the main oxidizing filler based on ammonium perchlorate and a chlorine scavenger, the compositions according to the invention have the advantage of igniting easily and of burning at moderate temperatures, of less than or equal to 2200 K, or even often less than or equal to 2000 K, while producing clean, nitrogen-rich, non-toxic gases which are very suitable for inflating motor-vehicle airbags.

When the binder, in the uncrosslinked state, is already in the solid state, as is frequently the case with binders based on an epoxy resin, the manufacture and processing of the compositions according to the invention will advantageously take place by pelletizing. In this case, the various solid constituents of the composition are ground separately, to particle sizes of between 10 and 50 micrometers, and are then mixed in the dry phase. The mixture thus produced is sized by passing over a hopper and compressed dry into pellets or discs. The crosslinkable binder is cured by hot curing, generally for two-and-a-half hours at 100° C. or for thirty minutes at 120° C.

When the binder, in the uncrosslinked state, is still in the liquid state, as is the case with polyacrylic rubbers having reactive terminal groups, with the binders based on a silicone resin, but also with certain binders based on an epoxy resin, the manufacture and the processing of the compositions according to the invention would advantageously take place by extrusion at so-called "room" temperature, that is to say approximately 20° C. To do this, the binder, generally diluted in a solvent, for example trichloroethylene, methyl ethyl ketone or toluene, is introduced into a temperature-controlled single-screw extruder. The ground solid constituents, as described above, are then added and the paste obtained is extruded to the desired geometry, for example in the form of a tubular strand, of a multiperforated lobate ring or of a multiperforated cylinder. After cutting to the desired length and removing the solvent by drying, the crosslinkable binder is cured by hot curing.

A detailed description of a preferred embodiment of the invention is given below.

The compositions according to the invention are therefore basically in the form of composite pyrotechnic compositions consisting essentially of a crosslinkable reducing binder, of a main oxidizing filler based on ammonium perchlorate and at least one chlorine scavenger and of reactive additives.

The binder is a crosslinkable reducing binder, the weight content of which represents at most 10% of the total weight of the composition. The compositions according to the invention are therefore compositions with a low binder content. Preferably, the binder weight content will be between 6 and 10%. The preferred binders are reducing binders based on an epoxy resin, based on a silicone resin or based on polyacrylic rubbers having hydroxyl terminal groups or epoxy terminal groups.

Before crosslinking, these various binders may be either in the liquid state or in the solid state in the form of a moulding powder which is curable at low temperature. The former will be preferred for compositions intended to be processed by extrusion while the latter will be preferred for compositions intended to be processed by pelletizing.

The weight content of the main oxidizing filler is between 50% and 75% of the total weight of the composition, and preferably it will be between 70% and 75% thereof. This main oxidizing filler necessarily contains a mixture of ammonium perchlorate and of a chlorine scavenger chosen from sodium nitrate, lithium carbonate and potassium carbonate. The chlorine scavenger will often be sodium nitrate. The ammonium perchlorate/chlorine scavenger weight ratio will be less than 5.0 and advantageously less than 4.0. In order to guarantee a very low nitrogen-oxide content and a combustion temperature of less than 2200 K, often about 2000 K, the ammonium perchlorate/chlorine scavenger weight ratio will preferably be less than 1.5 and often close to 0.95.

In order to favour even more the fixation of the chlorine coming from the ammonium perchlorate, it will advantageously be possible to use particles of ammonium perchlorate coprecipitated with the chlorine scavenger, especially when the latter is sodium nitrate.

Moreover, the main oxidizing filler may also, alongside the ammonium perchlorate, contain potassium perchlorate which, by virtue of the potassium ion, possesses an internal chlorine scavenger.

In order to further improve the quality of the gases produced and to guarantee good ignition and good combustion behaviour of the compositions according to the invention, the latter contain, alongside the main oxidizing filler, reactive additives which comprise, on the one hand, a copper compound chosen from the group consisting of cupric oxide CuO and of basic copper nitrate $Cu(NO_3)_2.3Cu(OH)_2$ and, on the other hand, an organic nitrogen compound chosen from the group consisting of nitroguanidine, guanidine nitrate, oxamide, dicyandiamide and metal cyanamides. Among metal cyanamides, sodium, zinc and copper cyanamides are preferred, zinc cyanamide $ZnCN_2$ more particularly preferred.

It is possible to incorporate into the composition, alongside the said reactive additives, additional additives. In the case of compositions intended to be processed by extrusion, it is possible, for example, to incorporate, as an additional additive, silicone microbeads. The constituents of the main oxidizing filler as well as the various additives that can be used within the context of the invention are in solid form and will be finely ground, generally to particle sizes of between 10 and 50 $\mu$m, before being used for formulating and for processing the compositions.

The examples which follow illustrate a few possible ways of using the invention, without limiting its scope.

EXAMPLES 1 TO 31

The following compositions were manufactured and formed into 7 mm diameter pellets, the oxidizing filler of which compositions consists of the mixture $NH_4ClO_4$+ $NaNO_3$. The binder was ground to a particle size of between 20 and 30 $\mu$m, the ammonium perchlorate to a particle size of between 10 and 50 $\mu$m, the sodium nitrate and the organic nitrogen compounds to a particle size of about 30 $\mu$m and the copper compounds to a particle size of a few $\mu$m.

When the ammonium perchlorate and the sodium nitrate are used in the form of coprecipitated particles, it is not necessary to carry out a pregrinding operation; in fact, these particles have a particle size of between 10 and 50 $\mu$m, often about 20 $\mu$m.

Table No. 1 which follows summarizes the contents of the various compositions in percentages by weight.

The abbreviations used have the following meanings:

| | | |
|---|---|---|
| AP/SN | = | ammonium perchlorate/sodium nitrate weight ratio; |
| NGu | = | nitroguanidine; |
| GN | = | guanidine nitrate; |
| Oxam | = | oxamide; |
| BCuN | = | basic copper nitrate; |
| Y | = | gas yield (in mol per 100 g of composition); |
| Sil | = | silicone; |
| Epo | = | epoxy; |
| Fil | = | $NH_4ClO_4$ + $NaNO_3$; |
| Ex | = | example. |

TABLE 1

| | Binder | | | | | | | | | |
|---|---|---|---|---|---|---|---|---|---|---|
| Ex | sil | epo | Fil | AP/SN | CuO | BCuN | GN | NGu | Oxam | Y |
| 1 | — | 4 | 75 | 0.95 | 13 | — | — | 8 | — | 2.3 |
| 2 | — | 6 | 75 | 0.95 | — | 11 | 8 | — | — | 2.5 |
| 3 | — | 5 | 75 | 0.95 | 12 | — | — | 8 | — | 2.4 |
| 4 | — | 6 | 75 | 0.95 | 11 | — | 8 | — | — | 2.4 |
| 5 | 6 | — | 75 | 0.95 | 11 | — | 8 | — | — | 2.4 |
| 6 | — | 6 | 75 | 0.95 | 10 | — | 9 | — | — | 2.5 |
| 7 | — | 6 | 75 | 0.95 | — | 11 | — | 8 | — | 2.6 |
| 8 | — | 7 | 75 | 0.95 | — | 11 | 7 | — | — | 2.55 |
| 9 | — | 6 | 70 | 0.95 | 16 | — | — | 8 | — | 2.3 |
| 10 | — | 7 | 70 | 0.95 | 16 | — | 7 | — | — | 2.3 |
| 11 | — | 6 | 75 | 0.95 | 11 | — | — | 8 | — | 2.4 |
| 12 | — | 7 | 75 | 0.95 | 11 | — | 7 | — | — | 2.4 |
| 13 | 6 | — | 75 | 0.95 | 11 | — | — | 8 | — | 2.4 |
| 14 | — | 6 | 75 | 0.95 | 8 | — | 11 | — | — | 2.55 |
| 15 | — | 7 | 75 | 0.95 | 9 | — | 9 | — | | 2.5 |
| 16 | — | 7 | 75 | 0.95 | 11 | — | — | 7 | — | 2.4 |
| 17 | 8 | — | 77 | 0.95 | 10 | — | 5 | — | — | 2.4 |
| 18 | — | 8 | 75 | 0.95 | — | 9 | 8 | — | — | 2.61 |
| 19 | 8 | — | 75 | 0.95 | 12 | — | — | 5 | | 2.3 |
| 20 | — | 8 | 75 | 0.95 | 9 | — | 8 | — | — | 2.6 |
| 21 | — | 7 | 70 | 0.95 | 11 | — | 12 | — | — | 2.5 |
| 22 | 8 | — | 70 | 0.95 | 14 | — | 8 | — | — | 2.3 |
| 23 | 8 | — | 75 | 0.95 | 9 | — | 8 | — | — | 2.5 |
| 24 | — | 6 | 70 | 0.95 | 11 | — | — | 13 | — | 2.5 |
| 25 | — | 8 | 75 | 0.95 | 9 | — | — | 8 | — | 2.5 |
| 26 | — | 7 | 70 | 0.95 | 8 | — | 15 | — | — | 2.7 |
| 27 | 8 | — | 77 | 0.95 | 5 | — | 10 | — | | 2.6 |
| 28 | 8 | — | 75 | 0.95 | 9 | — | — | 8 | | 2.5 |
| 29 | — | 6 | 73 | 0.95 | 6 | — | — | 15 | | 2.5 |
| 30 | 8 | — | 70 | 0.95 | 14 | — | — | 8 | | 2.3 |
| 31 | — | 8 | 75 | 0.95 | 9 | — | — | — | 8 | 2.5 |

The theoretical evaluation of the performance of these compositions in a gas generator for a 60-litre airbag is given in Table No. 2 which follows.

The abbreviations used have the following meanings:

| | | |
|---|---|---|
| $T_c$(K) | = | combustion temperature in kelvin; |
| CO(ppm) | = | content of carbon monoxide gases, expressed in ppm (with respect to a volume of 2.5 $m^3$); |
| NOx(ppm) | = | overall content of nitrogen oxide gases, expressed in ppm (with respect to a volume of 2.5 $m^3$); |
| res@$T_c$ | = | overall content of solid residues in the gases at the combustion temperature, expressed as a percentage; |
| res@1000K | = | overall content of solid residues in the gases at 1000K, expressed as a percentage. (1000K corresponds approximately to the generator outlet temperature). |

TABLE 2

| Ex | $T_c$ (K) | CO (ppm) | NOx (ppm) | res @ $T_c$ | res @ 1000 K |
|---|---|---|---|---|---|
| 1 | 1570 | 0 | 11 | 39 | 39 |
| 2 | 1636 | 0 | 12 | 32 | 33 |
| 3 | 1640 | 0 | 13 | 37 | 38 |
| 4 | 1650 | 0 | 13 | 35 | 37 |
| 5 | 1660 | 0 | 13 | 36 | 38 |
| 6 | 1686 | 0 | 14 | 34 | 36 |

TABLE 2-continued

| Ex | $T_c$ (K) | CO (ppm) | NOx (ppm) | res @ $T_c$ | res @ 1000 K |
|---|---|---|---|---|---|
| 7 | 1693 | 0 | 17 | 32 | 33 |
| 8 | 1703 | 0 | 15 | 32 | 33 |
| 9 | 1720 | 0 | 16 | 38 | 40 |
| 10 | 1730 | 0 | 16 | 38 | 40 |
| 11 | 1735 | 0 | 17 | 35 | 37 |
| 12 | 1745 | 0 | 17 | 35 | 37 |
| 13 | 1750 | 0 | 18 | 36 | 38 |
| 14 | 1754 | 0 | 17 | 32 | 34 |
| 15 | 1809 | 0 | 20 | 32 | 35 |
| 16 | 1815 | 0 | 21 | 34 | 37 |
| 17 | 1830 | 0 | 20 | 37 | 39 |
| 18 | 1858 | 0 | 21 | 29 | 32 |
| 19 | 1880 | 0 | 23 | 37 | 41 |
| 20 | 1890 | 0 | 23 | 32 | 34 |
| 21 | 1890 | 0 | 22 | 32 | 35 |
| 22 | 1910 | 0 | 24 | 37 | 41 |
| 23 | 1920 | 0 | 29 | 34 | 37 |
| 24 | 1925 | 0.1 | 26 | 31 | 35 |
| 25 | 1960 | 0.1 | 27 | 30 | 34 |
| 26 | 1965 | 0.2 | 26 | 28 | 32 |
| 27 | 1970 | 0.1 | 27 | 30 | 35 |
| 28 | 1990 | 0.2 | 29 | 33 | 37 |
| 29 | 1990 | 0.2 | 31 | 25 | 30 |
| 30 | 1990 | 0.2 | 26 | 36 | 41 |
| 31 | 2000 | 0.3 | 26 | 30 | 35 |

It is apparent from Tables 1 and 2 that the various compositions tried satisfy the objectives of the invention, compositions 1 to 21 being particularly useful since their combustion temperatures are very moderate and because of the fact that, for these compositions, there is almost equality between the values obtained for the solid residues at the combustion temperature and those obtained at 1000 K, which means that, in the case of these compositions, all of the solid residues are formed in the combustion chamber, before filtration.

EXAMPLES 32 TO 39

Table No. 3 which follows gives further compositions according to the invention, together with their theoretical evaluation. The abbreviations used are the same as before, with the new abbreviation "DCDA" standing for dicyandiamide.

TABLE 3

| | Example | | | | | | | |
|---|---|---|---|---|---|---|---|---|
| | 32 | 33 | 34 | 35 | 36 | 37 | 38 | 39 |
| Epo binder | 7 | 6 | 6 | 8 | 5 | 5 | 5 | 5 |
| $NH_4ClO_4$ + | 70 | 75 | 75 | 38 | 38 | 65 | 44 + | 22 |
| $NaNO_3$ | | | | | | | 10 | — |
| AP/SN | 1.42 | 1.42 | 1.42 | 1.42 | 1.42 | 2.1 | | |
| $KClO_4$ | — | — | — | 37 | 37 | — | — | 37 |
| $Li_2CO_3$ | 6 | — | — | — | — | 10 | 21 | 16 |
| CuO | 16 | 8 | 10 | 9 | 9 | 11 | 11 | 11 |
| GN | — | 11 | 5 | 8 | 6 | — | — | — |
| DCDA | — | — | — | — | 5 | 9 | 9 | 9 |
| Oxam | — | — | 4 | — | — | — | — | — |
| $T_c$ (K) | 1870 | 1896 | 1898 | 1978 | 1990 | 2002 | 1940 | 1960 |
| Y | 2.5 | 2.7 | 2.6 | 2.2 | 2.2 | 2.6 | 2.34 | 1.93 |
| CO (ppm) | 0 | 0 | 0 | 0.2 | 0.2 | 0.45 | 0.6 | 0.4 |
| NOx (ppm) | 21 | 23 | 22 | 26 | 29 | 20 | 11 | 18 |
| res @ $T_c$ | 32 | 26 | 27 | 31 | 31 | 25 | 30 | 37 |
| res @ 1000 K | 35 | 29 | 31 | 39 | 39 | 34 | 36 | 45 |

Complementary Results

The pellets of example 11, 25, 37, 38 and 39 were used to fill gas generators for a 60-litre airbag. These generators were placed in 60-litre containers and ignited. The actual combustion temperature of the charges was measured, together with the concentrations of carbon monoxide and of nitrogen oxides of the gases inside the said containers, using "DRAEGER" tubes.

The results were as follows:

charge consisting of pellets of Example 11: combustion temperature: 1735 K concentration of nitrogen oxides: 1500–2500 ppm concentration of carbon monoxide: 400 ppm;

charge consisting of pellets of Example 25: combustion temperature: 1960 K concentration of nitrogen oxides: 1500–2000 ppm concentration of carbon monoxide: 1000 ppm;

charge consisting of pellets of Example 37: combustion temperature: 2002 K concentration of nitrogen oxides: 1500 ppm concentration of carbon monoxide: 1500 ppm;

charge consisting of pellets of Example 38: combustion temperature: 1940 K concentration of nitrogen oxides: 700 ppm concentration of carbon monoxide: >3000 ppm;

charge consisting of pellets of Example 39: combustion temperature: 1960 K concentration of nitrogen oxides: 900 ppm concentration of carbon monoxide: 1200 ppm.

What is claimed is:

1. A pyrotechnic gas-generating composition comprising:

a) a crosslinked reducing binder representing at most 10% of the total weight of the composition chosen from the group consisting of crosslinkable reducing binders based on silicone resin, based on epoxy resin and based on polyacrylic rubbers having reactive terminal groups;

b) a main oxidizing filler representing between 50% and 75% of the total weight of the composition and comprising at least a mixture of ammonium perchlorate and a chlorine scavenger chosen from the group consisting of sodium nitrate, lithium carbonate and potassium carbonate, the ammonium perchlorate/chlorine scavenger weight ratio being less than 5.0; and c) additives comprising at least one copper compound and at least one organic,nitrogen compound, wherein the at least one copper compound is chosen from the group consisting of cupric oxide CuO representing between 5% and 16% of the total weight of the composition and basic copper nitrate $Cu(NO_3)_2$ $3Cu(OH)_2$ representing approximately 10% of the total weight of the composition and wherein the at least one organic nitrogen compound is chosen from the group consisting of nitro-guanidine, guanidine nitrate, oxamide, dicyandiamide and metal cyanamides representing between 5% and 15% of the total weight of the composition.

2. The composition according to claim 1, wherein the weight content of said binder is between 6% and 10% of the total weight of the composition.

3. The composition according to claim 2, wherein the weight content of said main oxidizing filler is between 70% and 75% of the total weight of the composition.

4. The composition according to claim 3, wherein the ammonium perchlorate/chlorine scavenger weight ratio is less than 4.0.

5. The composition according to claim 1, wherein the ammonium perchlorate/chlorine scavenger weight ratio is less than 1.5.

6. The composition according to claim 1, wherein said main oxidizing filler comprises coprecipitated ammonium perchlorate and sodium nitrate.

7. The composition according to claim 6, wherein the coprecipitated ammonium perchlorate and sodium nitrate particles have a particle size of between 10 $\mu$m and 50 $\mu$m.

8. The composition according to claim 5, wherein the ammonium perchlorate/chlorine scavenger weight ratio is approximately 0.95.

9. Composition according to claim 1, characterized in that the said metal cyanamides consist of sodium, zinc and copper cyanamides.

10. Composition according to claim 9, characterized in that the said metal cyanamide is zinc cyanamide $ZnCN_2$.

11. Composition according to claim 1, characterized in that the said main oxidizing filler also contains potassium perchlorate.

12. The composition according to claim 1, wherein said binder is a crosslinkable reducing binder based on an epoxy resin, said chlorine scavenger is sodium nitrate, and the additives contain basic copper nitrate and guanidine nitrate.

* * * * *